US011304861B2

(12) United States Patent
Xu et al.

(10) Patent No.: US 11,304,861 B2
(45) Date of Patent: Apr. 19, 2022

(54) PATIENT TRANSPORT APPARATUS WITH MOVABLE END HANDLE SYSTEM

(71) Applicant: Stryker Corporation, Kalamazoo, MI (US)

(72) Inventors: Shaofei Wilson Xu, Kalamazoo, MI (US); Kaitlin Konopacz, Lake Zurich, IL (US); Gwynneth Cunningham, Kalamazoo, MI (US); Alexander Christopher McDavid, Atlanta, GA (US); Justin Thomas McLouth, Portage, MI (US); Shawn Trimble, Portage, MI (US); Neil Feliksa, Kalamazoo, MI (US); Christopher Gentile, Sturgis, MI (US); Jennifer Ryan, Ann Arbor, MI (US); Erik P. Eagleman, Madison, WI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 16/944,764

(22) Filed: Jul. 31, 2020

(65) Prior Publication Data

US 2021/0030606 A1 Feb. 4, 2021

Related U.S. Application Data

(60) Provisional application No. 62/882,089, filed on Aug. 2, 2019.

(51) Int. Cl.

| | |
|---|---|
| ***A61G 1/04*** | (2006.01) |
| ***A61G 1/048*** | (2006.01) |
| ***A61G 1/02*** | (2006.01) |
| *A61G 1/017* | (2006.01) |

(52) U.S. Cl.

CPC ..... *A61G 1/04* (2013.01); *A61G 1/02* (2013.01); *A61G 1/048* (2013.01); *A61G 1/017* (2013.01)

(58) Field of Classification Search

CPC . A61G 1/04; A61G 1/048; A61G 1/02; A61G 7/1046; A61G 7/053

USPC ..... 5/625, 86.1, 81.1 R, 662, 658

See application file for complete search history.

(56) References Cited

U.S. PATENT DOCUMENTS 5,060,327 A * 10/1991 Celestina ..... A61G 13/0009 5/662
5,069,465 A * 12/1991 Stryker ..... A61G 1/048 280/47.371
5,388,294 A * 2/1995 Reeder ..... A61G 7/05 280/47.371

(Continued)

*Primary Examiner* — Robert G Santos
(74) *Attorney, Agent, or Firm* — Howard & Howard Attorneys PLLC

(57) ABSTRACT

Patient transport apparatus including a patient litter and a litter support apparatus for supporting the patient litter from a ground surface. The litter support apparatus includes a litter support frame including a pair of litter supports spaced a distance apart to define a loading gap for receiving the patient litter therethrough. A handle system is coupled to the pair of litter supports and includes a handle assembly that is positionable between a closed configuration and an open configuration. The handle assembly extends across the loading gap defined between the pair of litter supports in the closed configuration and is positioned away from the loading gap in the open configuration.

20 Claims, 11 Drawing Sheets

(56) References Cited

U.S. PATENT DOCUMENTS 5,479,666 A * 1/1996 Foster ..... A61G 7/002 297/423.3
5,806,111 A * 9/1998 Heimbrock ..... A61G 1/0225 280/47.371
7,398,571 B2 7/2008 Souke et al.
7,452,032 B1 * 11/2008 Roleder ..... A61G 15/12 297/330
7,789,187 B2 * 9/2010 Zerhusen ..... A61G 1/0237 180/323
8,381,337 B2 * 2/2013 Zerhusen ..... A61G 7/053 5/662
8,413,270 B2 * 4/2013 Turner ..... A61G 7/0524 5/430
8,621,688 B2 * 1/2014 Andrienko ..... A61G 7/015 5/430
8,713,727 B2 * 5/2014 Heimbrock ..... A61G 7/0513 5/430
8,745,786 B2 * 6/2014 Andrienko ..... A47C 21/08 5/430
9,173,797 B2 * 11/2015 Andrienko ..... A61G 7/16
9,486,373 B2 11/2016 Lambarth et al.
9,510,981 B2 12/2016 Lambarth et al.
9,756,954 B2 * 9/2017 Andrienko ..... A61G 7/0507
10,369,063 B2 * 8/2019 Matheny ..... A61G 5/10
10,869,791 B2 * 12/2020 Matheny ..... A61G 5/10
11,039,965 B2 * 6/2021 Rowland ..... A61G 5/1067
11,052,005 B2 * 7/2021 Childs ..... A61G 5/006
2009/0188731 A1 * 7/2009 Zerhusen ..... A61G 1/0281 180/19.3
2012/0023666 A1 * 2/2012 Heimbrock ..... A61G 7/0507 5/428
2012/0102643 A1 * 5/2012 Turner ..... A61G 7/16 5/430
2012/0102655 A1 * 5/2012 Zerhusen ..... A61G 7/0513 5/662
2012/0110735 A1 * 5/2012 Andrienko ..... A61G 7/0514 5/430
2012/0124746 A1 * 5/2012 Andrienko ..... A61G 7/0514 5/618
2012/0144587 A1 * 6/2012 Andrienko ..... A61G 7/16 5/618
2012/0246830 A1 * 10/2012 Hornbach ..... A61G 7/015 5/619
2014/0109317 A1 * 4/2014 Andrienko ..... A61G 7/051 5/618
2014/0283300 A1 * 9/2014 Andrienko ..... A61G 7/0507 5/430
2018/0028383 A1 2/2018 Stryker et al.
2018/0280212 A1 * 10/2018 Matheny ..... A61G 1/02
2019/0083338 A1 * 3/2019 Childs ..... A61G 7/16
2019/0321244 A1 * 10/2019 Matheny ..... A61G 1/02
2020/0113752 A1 * 4/2020 Rowland ..... A61G 1/048
2021/0030606 A1 * 2/2021 Xu ..... A61G 1/02
2021/0069037 A1 * 3/2021 Matheny ..... A61G 5/10

* cited by examiner

PATIENT TRANSPORT APPARATUS WITH MOVABLE END HANDLE SYSTEM

CROSS-REFERENCE TO RELATED APPLICATION

The subject patent application claims priority to and all the benefits of U.S. Provisional Patent Application No. 62/882,089 filed on Aug. 2, 2019, the disclosure of which is hereby incorporated by reference in its entirety.

BACKGROUND

Patient transport apparatuses, such as hospital beds, stretchers, cots, tables, wheelchairs, and chairs facilitate care and transportation of patients. Conventional patient transport apparatuses comprise a base, lift device, and a litter comprising a patient support surface upon which the patient is supported. The litter may be removable from the base to facilitate loading a patient onto the litter closer to the ground surface. Once the patient is loaded onto the litter near the ground surface, the litter is raised and disposed on the base to then transport the patient.

Traditionally, a patient transport apparatus includes pushing and/or lifting handles located at a foot end of the patient transport apparatus to enable caregivers to more easily move the patient transport apparatus. However, these pushing and/or lifting handles obstruct the foot end of the patient transport apparatus, which may cause difficulty when removing the litter from the base and/or when placing the litter onto the base.

Therefore, a patient transport apparatus that addresses one or more of the aforementioned challenges is desired.

BRIEF DESCRIPTION OF THE DRAWINGS

Advantages of the present disclosure will be readily appreciated as the same becomes better understood by reference to the following detailed description when considered in connection with the accompanying drawings.

DETAILED DESCRIPTION

Figure 1:
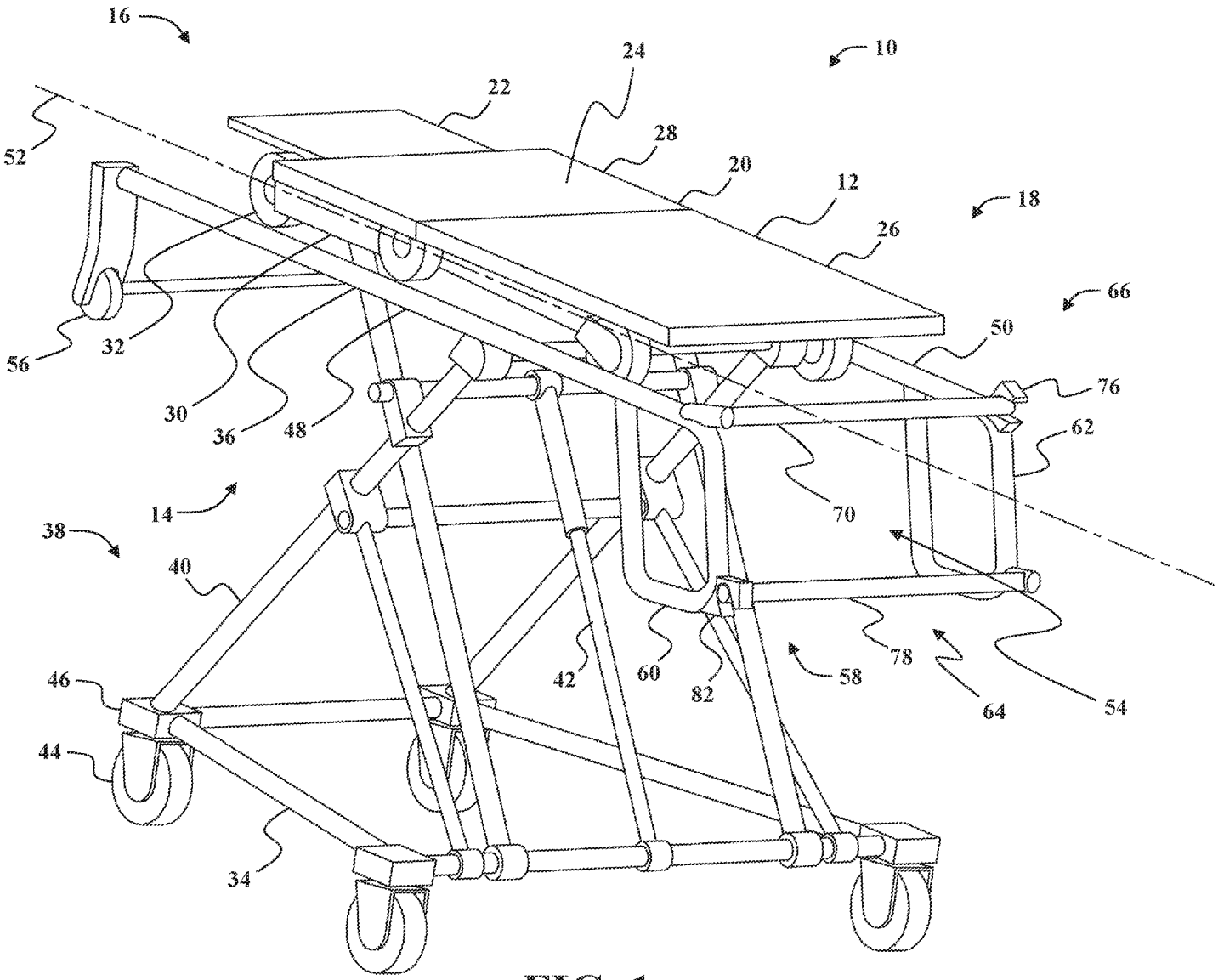
FIG. 1 is a perspective view of a patient transport apparatus including a movable end handle system in a closed configuration.

Referring to FIGS. 1-6, a patient transport apparatus 10 is shown for supporting a patient in a health care setting according to embodiments of the present disclosure. As will be appreciated from the subsequent description below, while the illustrated embodiments of the patient transport apparatus 10 described herein are configured as cots for transporting patients, the patient transport apparatus 10 may comprise a hospital bed, a stretcher, a table, a wheelchair, a chair, or a similar apparatus utilized in the care of a patient.

The patient transport apparatus 10 comprises a patient litter 12 and a litter support apparatus 14 for supporting the litter 12 above a ground surface. The litter 12 and the litter support apparatus 14 each have a head end 16 and a foot end 18 corresponding to designated placement of the patient's head and feet on the patient transport apparatus 10. The litter 12 is configured to be removably supported by the litter support apparatus 14 and may be separated from the litter support apparatus 14 to facilitate loading the patient onto the litter 12. For example, in operation, the litter 12 is removed from the litter support apparatus 14 by one or more caregivers and maybe placed on the ground surface next to a patient. The patient is then placed onto the litter 12. The litter 12 with the patient supported thereon are then loaded onto the litter support apparatus 14. The caregiver(s) may then load the litter support apparatus 14 with the patient into an ambulance.

As is described in greater detail below, the litter support apparatus 14 is configured to removably receive and support the litter 12 in certain situations. Put differently, in the illustrated embodiments, the litter 12 is configured for releasable attachment to the litter support apparatus 14. As will be appreciated from the subsequent description below, the litter 12 may be considered to be a patient support apparatus both when it is attached to the litter support apparatus 14 and when it has been removed from the litter support apparatus 14.

The litter 12 may comprise a patient support deck 20 that includes several sections, some of which are capable of being articulated relative to others, such as a fowler section 22, a seat section 24, a foot section 26, or any combination thereof. The fowler section 22 and the foot section 26 may pivot relative to the seat section 24, or may articulate relative to the seat section 24 in any manner. For instance, the fowler section 22 and/or the foot section 26 may both pivot and translate relative to the seat section 24 in some configurations. The seat section 24 and/or foot section 26 may also support legs of the patient. The sections may extend in various lengths and may have various configurations. Deck panels 28 are disposed on each of the sections collectively forming or otherwise defining the patient support surface 26. The deck panels 28 may comprise rigid panels with or without padding or any other suitable materials for supporting the patient. A mattress (or sections thereof) may be disposed on or be integral with the litter 12. In such circumstances, the mattress comprises or otherwise defines a secondary patient support surface upon which the patient is supported.

In some embodiments, the litter 12 is configured to serve as a mobile chair to transport patients up and down stairs. Mobile chairs are used to evacuate patients from buildings where patient accessibility is limited, such as buildings having more than one floor.

In some embodiments, the litter 12 may include one or more support frames 30 that are coupled to the seat section 24 and/or foot section 26. The litter 12 may further include one or more wheels 32 rotatably coupled to the support frame 30 which are configured to be disposed in contact with the ground surface. In the illustrated embodiments, the wheels 32 are freely rotatable. In alternative embodiments, the wheels 32 may be powered drive wheels. The support frame 30 may also comprise tracks, such as powered drive tracks. One example of a litter 12 is shown in U.S. Patent Application Publication No. 2018/0028383, hereby incorporated herein by reference.

The litter support apparatus 14 comprises a base frame 34 and a litter support frame 36. The litter support frame 36 is spaced above the base frame 34. A lift device 38 may be coupled to the base frame 34 and the litter support frame 36 to raise and lower the litter support frame 36 to minimum and maximum heights of the patient transport apparatus 10, and intermediate positions therebetween, when the litter 12 is supported by the litter support apparatus 14. The lift device 38 includes one or more lift arms 40 coupling the litter support frame 36 to the base frame 34. The lift device 38 includes one or more lift actuators 42 that are coupled to at least one of the base frame 34 and the litter support frame 36 to raise and lower the litter support frame 36 and litter 12 relative to the ground surface and the base frame 34. The lift device 38 may be configured to operate in the same manner or a similar manner as the lift mechanisms shown in U.S. Pat. Nos. 7,398,571, 9,486,373, 9,510,981, and/or U.S. Patent Application Publication No. 2018/0028383, hereby incorporated herein by reference.

Wheels 44 are coupled to the base frame 34 to facilitate transport over ground surfaces. The wheels 44 are arranged in each of four quadrants of the litter support apparatus 14 adjacent to corners of the base frame 34. In the illustrated embodiments, the wheels 44 are caster wheels, which are able to rotate and swivel relative to the base frame 34 during transport. Each of the wheels 44 forms part of a caster assembly 46. Each caster assembly 46 is mounted to the base frame 34. It should be understood that various configurations of the caster assemblies 46 are contemplated. In addition, in some configurations, the wheels 44 are not caster wheels and may be non-steerable, steerable, non-powered, powered, or combinations thereof. Additional wheels 44 are also contemplated. For example, the patient transport apparatus 10 may comprise four non-powered, non-steerable wheels, along with one or more powered wheels. In some cases, the patient transport apparatus 10 may not include any wheels. In other configurations, one or more auxiliary wheels (powered or non-powered), which are movable between stowed positions and deployed positions, may be coupled to the base frame 34. A fifth wheel may also be arranged substantially in a center of the base. Other configurations are contemplated.

The litter support frame 36 is coupled to the base frame 34 and configured to support the litter 12 above the base frame 34. The litter 12 is removably coupled to the litter support frame 36. The litter support frame 36 includes a pair of litter supports 48, 50 that extend parallel to a longitudinal axis 52 between the foot end 18 and the head end 16 of the patient transport apparatus 10. The pair of litter supports 48, 50 include a first litter support 48 that is spaced a distance from a second litter support 50 to define a loading gap 54 between the first litter support 48 and the second litter support 50. The loading gap 54 is sized and shaped for receiving the litter 12 through the loading gap 54 to facilitate the litter 12 being loaded onto the litter support frame 36 by a caregiver. The litter support frame 36 may also include loading wheels 56 extending from the pair of litter supports 48, 50 proximate the head end 16 to facilitate loading and unloading of the patient transport apparatus 10 into/from a vehicle. For example, the loading wheels 56 may be positioned and configured to facilitate loading and unloading the patient transport apparatus 10 into/from an ambulance.

The litter support apparatus 14 also includes a handle system 58 positioned at the foot end 18 of the patient transport apparatus 10 to facilitate enabling a caregiver to move the patient transport apparatus 10 along the ground surface. The handle system 58 is coupled to the pair of litter supports 48, 50 at the foot end 18 of the patient transport apparatus 10. The handle system 58 includes a first support member 60 that is coupled to the first litter support 48, a second support member 62 that is coupled to the second litter support 50, and a movable handle assembly 64 that extends between the first and second support members 60, 62 and across the loading gap 54. The handle assembly 64 is positionable between a closed position/configuration 66 (shown in FIGS. 1, 3, 5, 6, 7A, and 10A) and an open position/configuration 68 (shown in FIGS. 2, 4, 7C and 10B). The handle assembly 64 is configured to extend across the loading gap 54 defined between the pair of litter supports 48, 50 in the closed configuration 66, and to be positioned away from the loading gap 54 in the open configuration 68. With the handle assembly 64 in the closed configuration 66, a caregiver may use the handle assembly 64 to facilitate pushing and/or pulling the patient transport apparatus 10 along the ground surface to transport the patient. With the handle assembly 64 in the open configuration 68 (see e.g., FIG. 2), the caregiver may more easily access the litter 12 through the loading gap 54 to remove the litter 12 from the litter support apparatus 14, or to more easily load the litter 12 onto the litter support apparatus 14 by moving the litter 12 through the loading gap 54 and onto the litter support apparatus 14.

Figure 2:
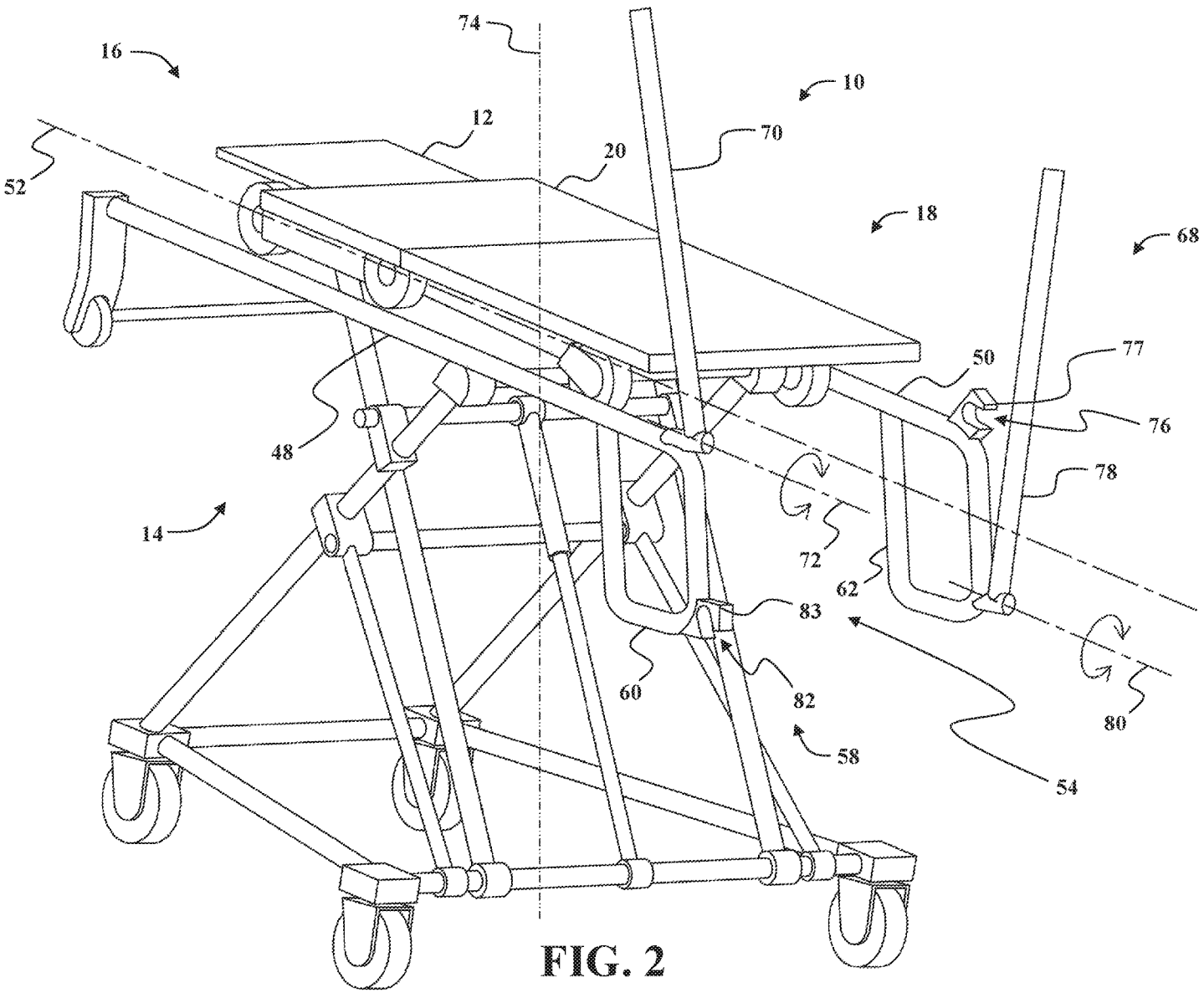
FIG. 2 is another perspective view of the patient transport apparatus of FIG. 1 with the end handle system in an open configuration.

Referring to FIGS. 1 and 2, in some embodiments, the handle assembly 64 includes an upper crossbar 70 that extends between the first support member 60 and the second support member 62. The upper crossbar 70 is pivotably coupled to the first support member 60 at one end and is configured to rotate about a first pivot axis 72 (shown in FIG. 2) that is orientated substantially parallel to the longitudinal axis 52. A pivot joint is provided between the upper crossbar 70 and the first support member 60 to facilitate this movement. In this manner, the upper crossbar 70 may be moved to the closed configuration 66 in which the upper crossbar 70 extends between the first support member 60 and the second support member 62 and across the loading gap 54, and may be moved to the open configuration 68 in which the upper crossbar 70 extends substantially upright, such as substantially parallel to a vertical axis 74. The upper crossbar 70 may be moved to any position that opens the loading gap 54. In some versions, the pivot joint between the upper crossbar 70 and the first support member 60 prohibits the upper crossbar 70 from falling under the force of gravity, e.g., the pivot joint provides suitable friction, position holding features, or the like to hold the upper crossbar 70 at the position in which the upper crossbar 70 was placed by the user. In other versions, the upper crossbar 70 is freely pivotable and falls under the force of gravity.

The second support member 62 may also include a first locking member 76 that is configured to engage a free end of the upper crossbar 70 in the closed configuration 66 to facilitate retaining the upper crossbar 70 in the closed configuration 66. The first locking member 76 may comprise a first retainer bracket 77 that is generally C-shaped to define an opening to receive the upper crossbar 70, which may have a generally circular cross-section and be sized to fit into the opening. The retainer bracket 77 may be disposed on the second support member 62 such that the upper crossbar 70 can be vertically lifted without slipping from the opening, e.g., an upper portion of the first retainer bracket 77 may depend downward slightly to retain the upper crossbar 70 in the opening during lifting. Other forms of locking members are also contemplated, e.g., detent locks, latch/catch arrangements, and the like.

The handle assembly 64 may also include a lower crossbar 78 that extends between the first support member 60 and the second support member 62. The lower crossbar 78 is spaced a vertical distance from the upper crossbar 70. The upper crossbar 70 and the lower crossbar 78 are each movable between the closed configuration 66 and the open configuration 68. The lower crossbar 78 is pivotably coupled to the second support member 62 at one end and is configured to rotate about a second pivot axis 80 that is orientated substantially parallel to the longitudinal axis 52. A pivot joint is provided between the lower crossbar 78 and the second support member 62 to facilitate this movement. In the closed configuration 66, the lower crossbar 78 extends between the first support member 60 and the second support member 62 across the loading gap 54. In the open configuration 68, the lower crossbar 78 is rotated to an upright position, such as substantially parallel to the vertical axis 74, or to any other position that opens the loading gap 54. In some versions, the pivot joint between the lower crossbar 78 and the second support member 62 prohibits the lower crossbar 78 from falling under the force of gravity, e.g., the pivot joint provides suitable friction, position holding features, or the like to hold the lower crossbar 78 at the position in which the lower crossbar 78 was placed by the user. In other versions, the lower crossbar 78 is freely pivotable and falls under the force of gravity.

The first support member 60 may include a second locking member 82 that is configured to engage a free end of the lower crossbar 78 with the lower crossbar 78 in the closed configuration 66 to facilitate retaining the lower crossbar 78 in the closed configuration 66. The second locking member 82 may also comprise a second retainer bracket 83 that is generally C-shaped to define an opening to receive the lower crossbar 78, which may have a generally circular cross-section and be sized to fit into the opening. The second retainer bracket 83 may be disposed on the first support member 60 such that the lower crossbar 78 can be vertically lifted without slipping from the opening, e.g., the second retainer bracket 83 is orientated so that the opening is directed vertically downward to retain the lower crossbar 78 in the opening during lifting. Other forms of locking members are also contemplated, e.g., detent locks, latch/catch arrangements, and the like.

Figure 3:
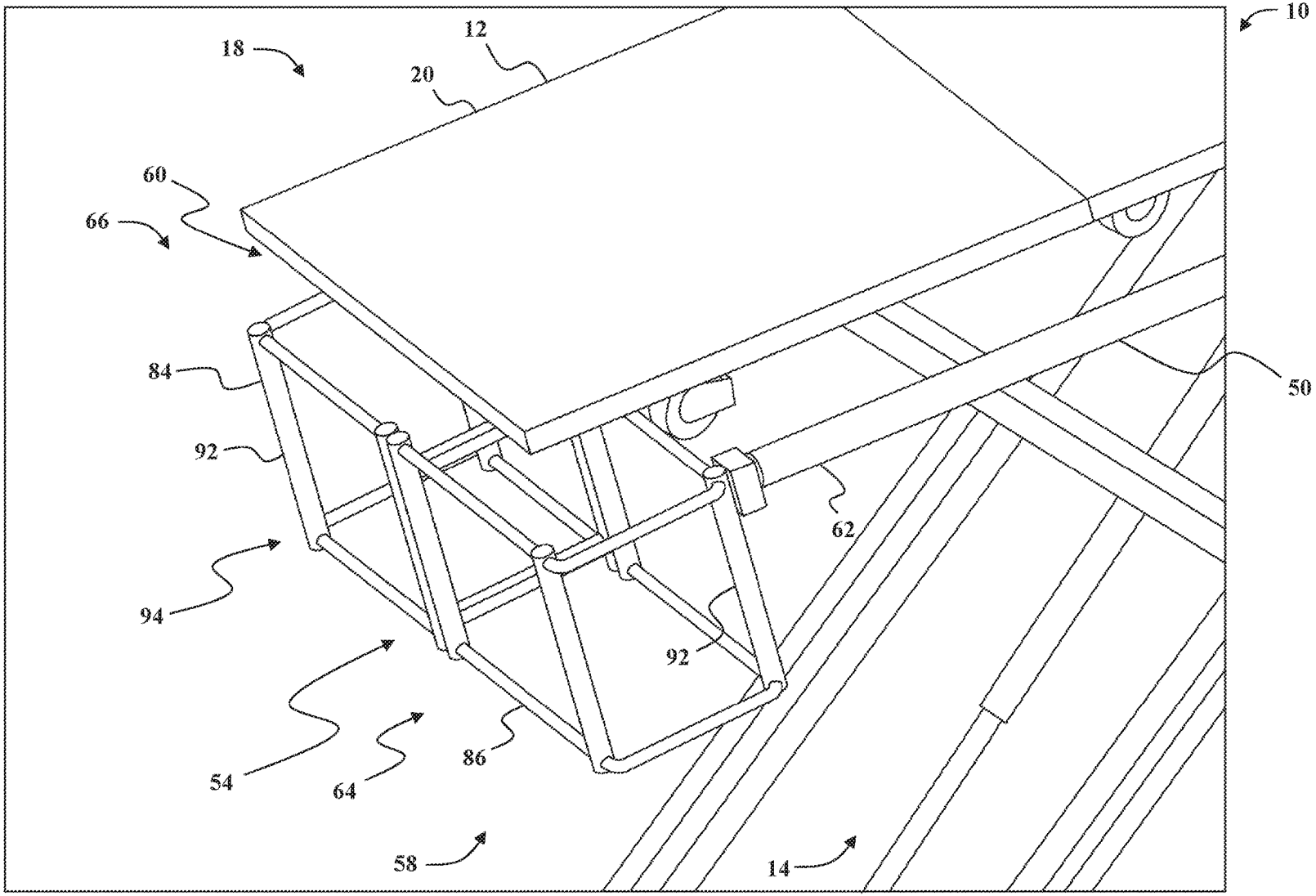
FIG. 3 is a perspective view of a portion of a patient transport apparatus including an end handle system in a closed configuration.
Figure 4:
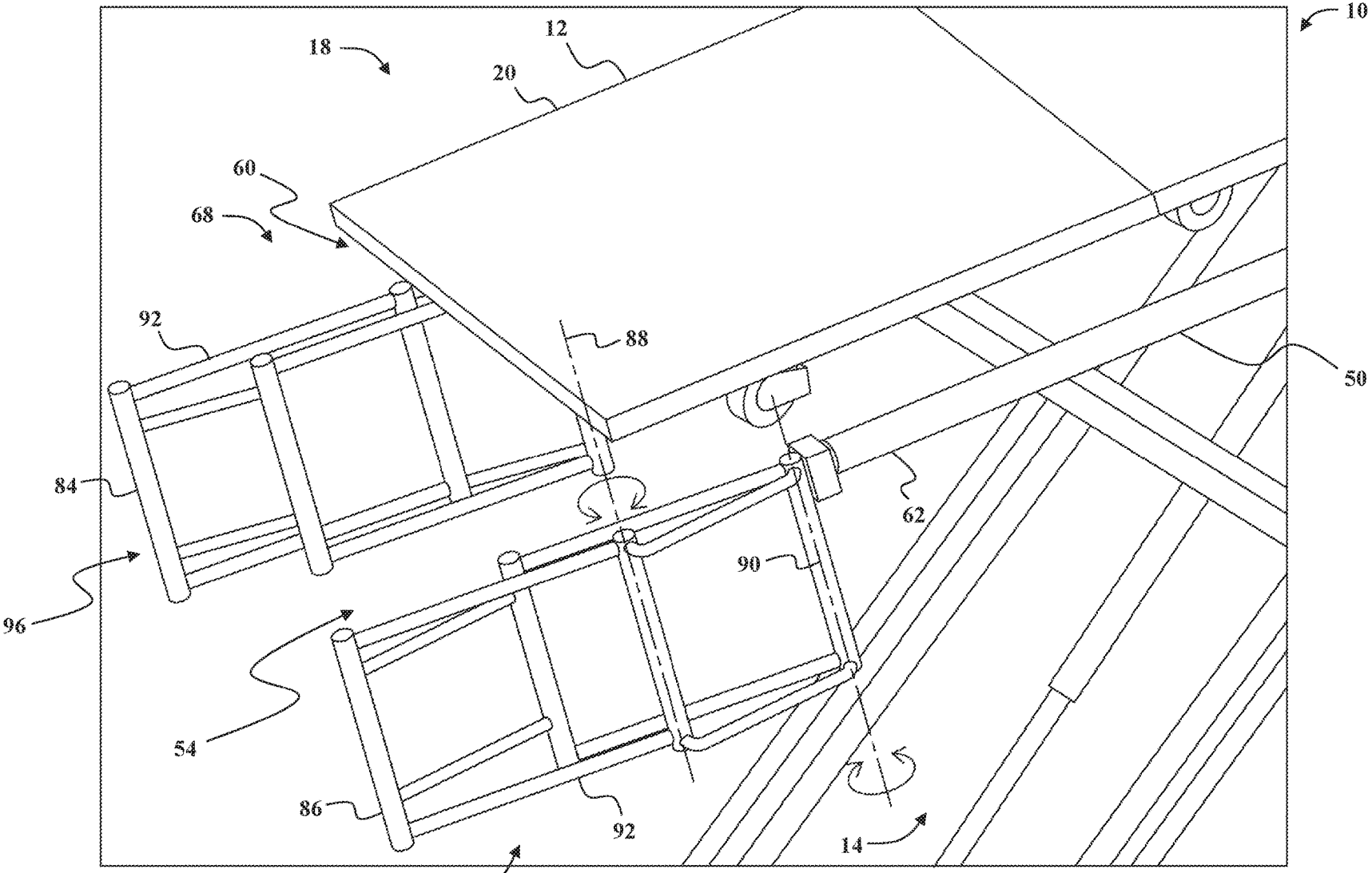
FIG. 4 is a perspective view of the patient transport apparatus of FIG. 3 with the end handle system in an open configuration.

Referring to FIGS. 3 and 4, in some embodiments, the handle assembly 64 may include a pair of collapsible cage assemblies 84, 86, that are movable between the open configuration 68 and the closed configuration 66. For example, the handle assembly 64 may include a first collapsible cage assembly 84 that is coupled to the first support member 60 and a second collapsible cage assembly 86 that is coupled to the second support member 62. The first collapsible cage assembly 84 may also be pivotably coupled to the first support member 60 and configured to rotate about a first vertical pivot axis 88 (shown in FIG. 4). The second collapsible cage assembly 86 may also be pivotably coupled to the second support member 62 and configured to rotate about a second vertical pivot axis 90. The first collapsible cage assembly 84 and the second collapsible cage assembly 86 each include a plurality of links 92 that are pivotably coupled together. The plurality of links 92 are configured (e.g., in a 4-bar linkage arrangement) to pivot with respect to one another to form a substantially rectangular shape 94 (shown in FIG. 3) and a substantially planar shape 96 (shown in FIG. 4).

In the closed configuration 66, the first collapsible cage assembly 84 and the second collapsible cage assembly 86 each form the substantially rectangular shape 94 such that each collapsible cage assembly 84, 86 extends across a portion of the loading gap 54. For example, as shown in FIG. 3, in the closed configuration 66, the first collapsible cage assembly 84 contacts the second collapsible cage assembly 86 such that the handle assembly 64 extends across the loading gap 54. A locking mechanism may be used to couple the first collapsible cage assembly 84 to the second collapsible cage assembly 86 in the closed configuration 66 to facilitate retaining the collapsible cage assemblies 84, 86 in the closed configuration 66. Any suitable locking mechanism may be employed, including a lock collar, a clamp, fasteners, or the like.

In the open configuration 68, the first collapsible cage assembly 84 and the second collapsible cage assembly 86 each form the substantially planar shape 96 such that the first collapsible cage assembly 84 is spaced apart from the second collapsible cage assembly 86 to defined the loading gap 54 between the first collapsible cage assembly 84 and the second collapsible cage assembly 86.

Referring to FIGS. 5-7F, in some embodiments, the handle assembly 64 comprises a wagon handle assembly 98 that extends between the first support member 60 and the second support member 62. The wagon handle assembly 98 is pivotably coupled to the first support member 60 and is movable between the closed configuration 66 in which the wagon handle assembly 98 extends across the loading gap 54, and the open configuration 68 in which the wagon handle assembly 98 is moved to a stowed position/configuration 100 (shown in FIG. 7F) adjacent to a side of the patient transport apparatus 10.

Figure 5A:
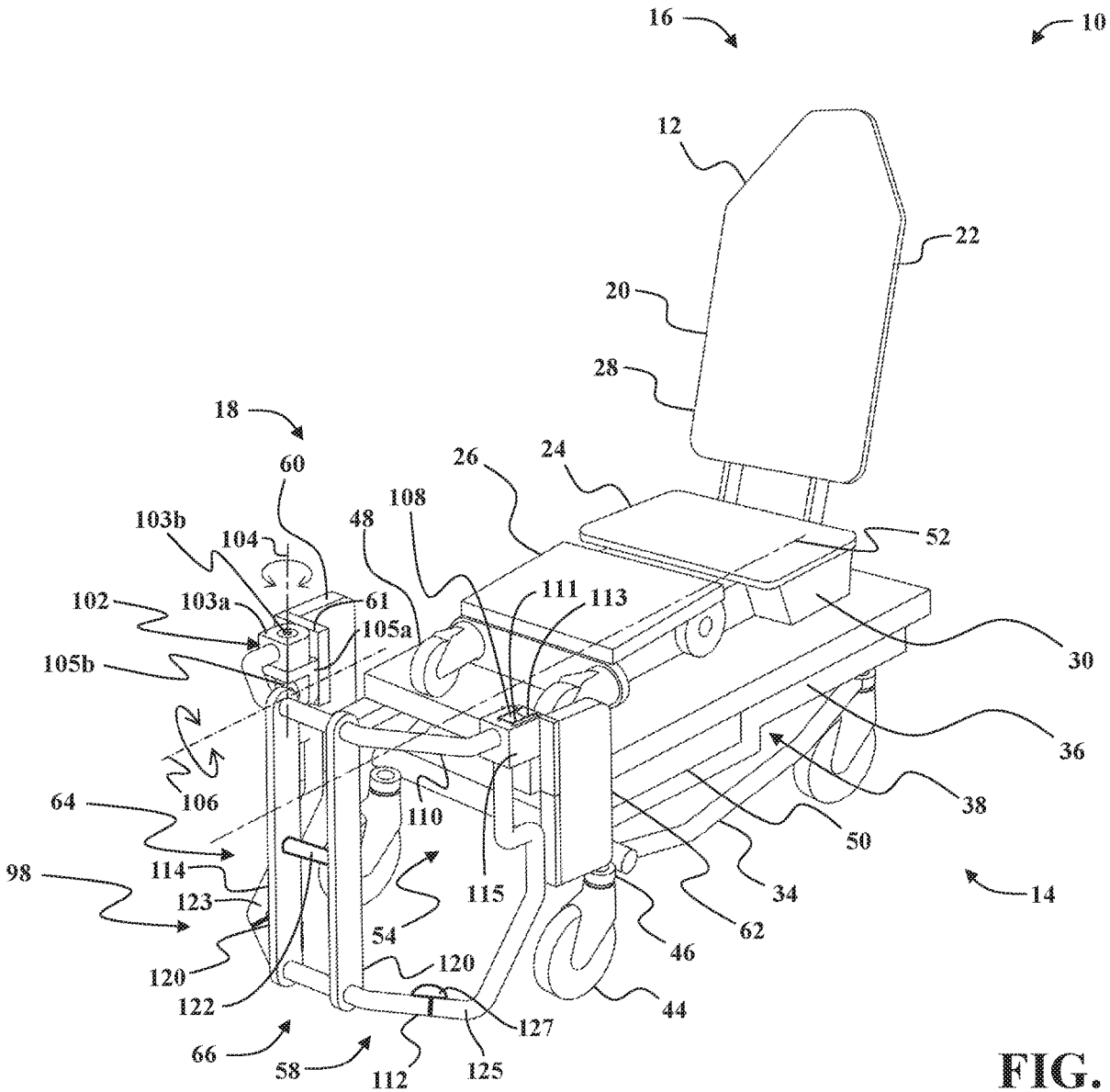
FIGS. 5A and 5B are perspective views of a patient transport apparatus including different versions of a movable end handle system.
Figure 5B:
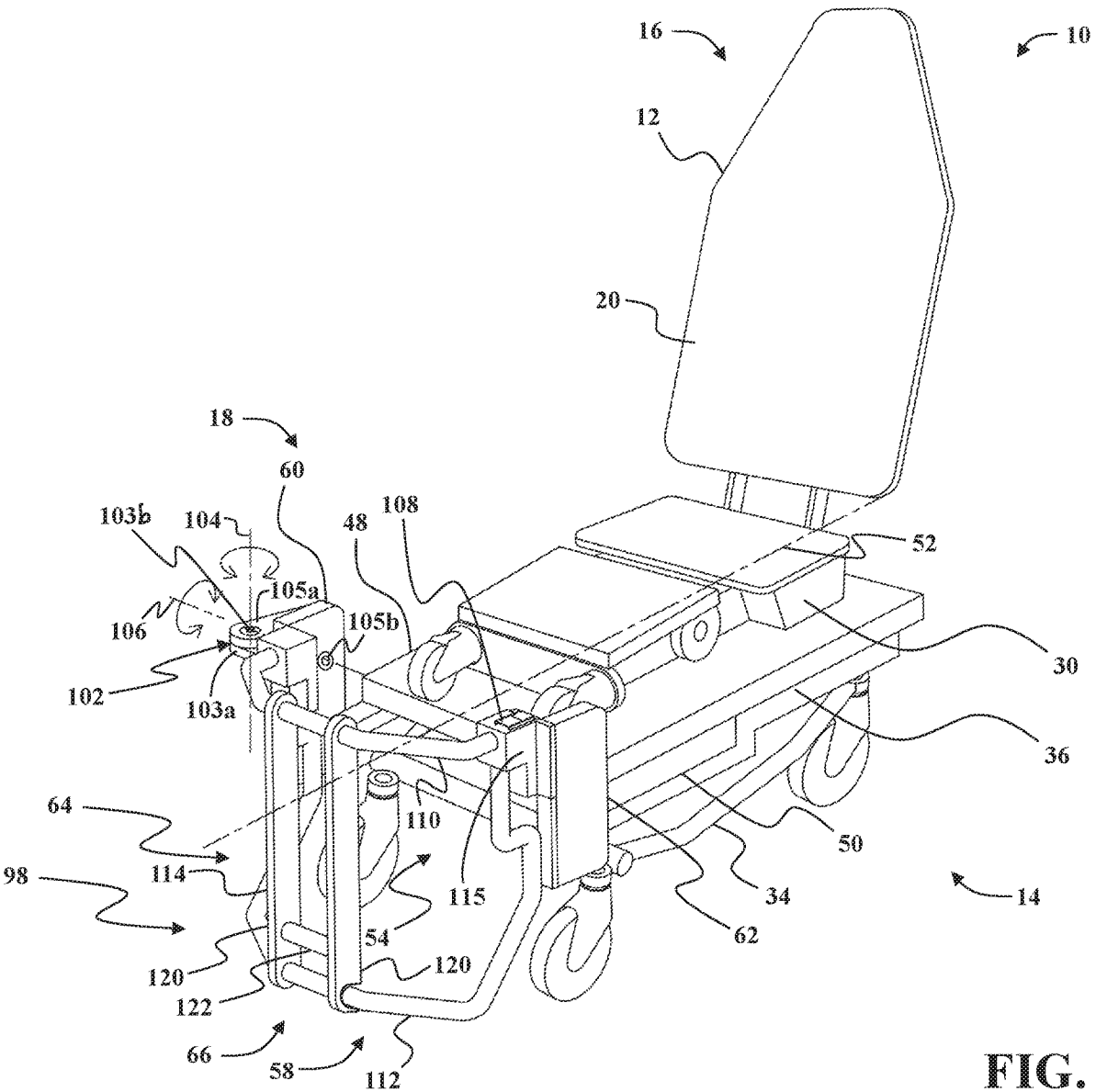
Figure 6:
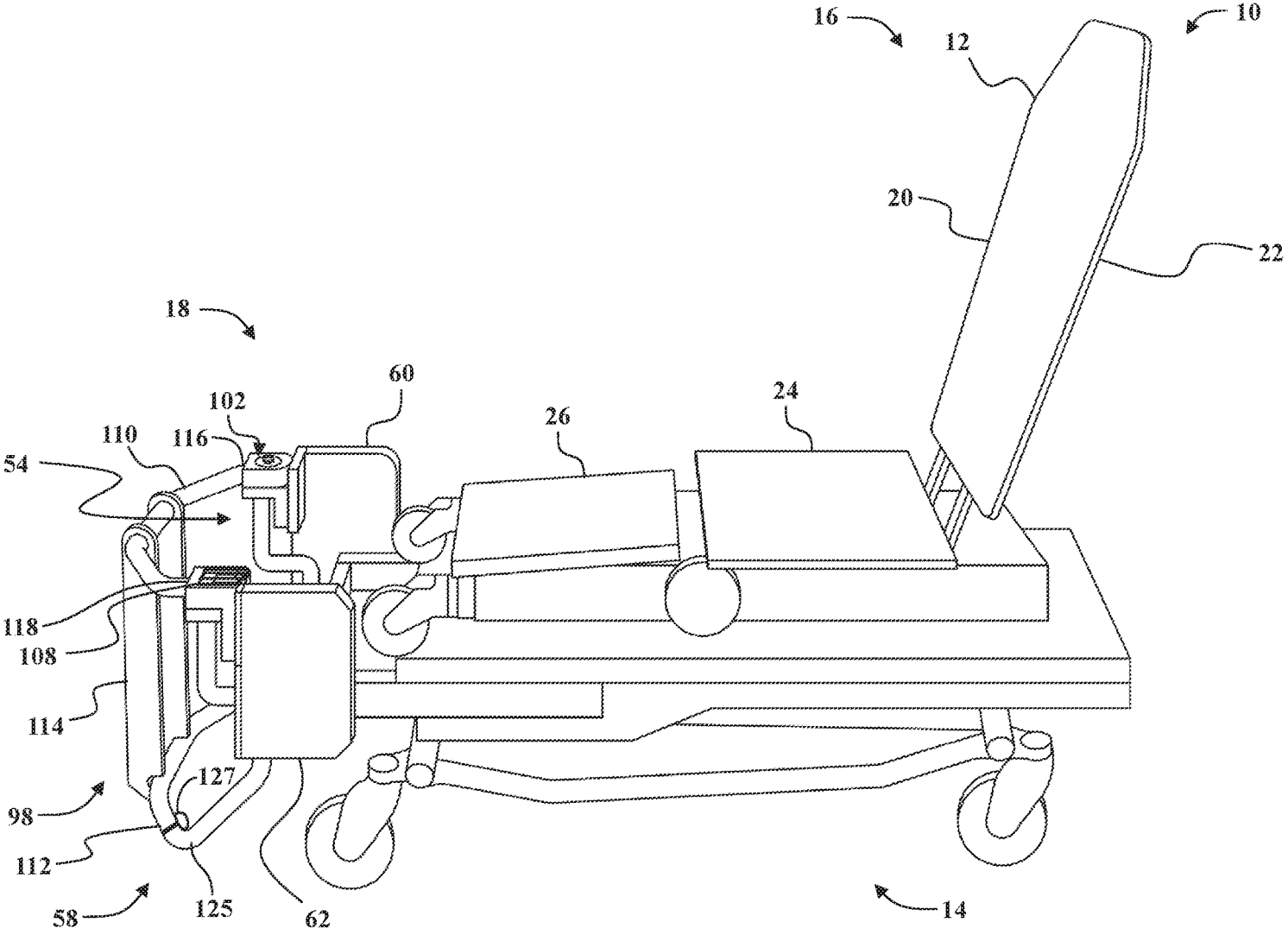
FIG. 6 is a side view of the patient transport apparatus shown in FIG. 5A.

The wagon handle assembly 98 includes a pivot support 102 that is pivotally coupled to the first support member 60. The pivot support 102 is configured to facilitate rotation of the wagon handle assembly 98 about a first vertical pivot axis 104 and a second pivot axis 106 that is perpendicularly oriented relative to the first vertical axis 104 to enable the wagon handle assembly 98 to pivot away from the foot end 18 of the patient transport apparatus 10 and move to the stowed configuration 100 along the side of the litter support apparatus 14. The pivot support 102 may comprise a U-joint, spherical joint, gimbaled connection, or the like to enable the wagon handle assembly 98 to move in two or more degrees of freedom. In some embodiments, the pivot support 102 includes a first pivot block 103*a* with first pivot pin 103*b* that enables the pivot support 102 to pivot about the first vertical pivot axis 104 relative to the first support member 60. The pivot support 102 may further comprise a second pivot block 105*a* with second pivot pin 105*b* that enables the pivot support 102 to pivot about the second pivot axis 106. The second pivot block 105*a* is pivotally coupled to a front panel 61 of the first support member 60 via the second pivot pin 105*b* as shown in FIG. 5A. The first pivot block 103*a* is pivotally coupled to the second pivot block 105*a* via the first pivot pin 103*b*. As shown in FIG. 5A, the second pivot pin 105*b* may be orientated such that the second pivot axis 106 is parallel to the longitudinal axis 52. As shown in FIG. 5B, in another version, the second pivot pin 105*b* may be orientated such that the second pivot axis 106 is substantially perpendicular to the longitudinal axis 52.

Figure 8A:
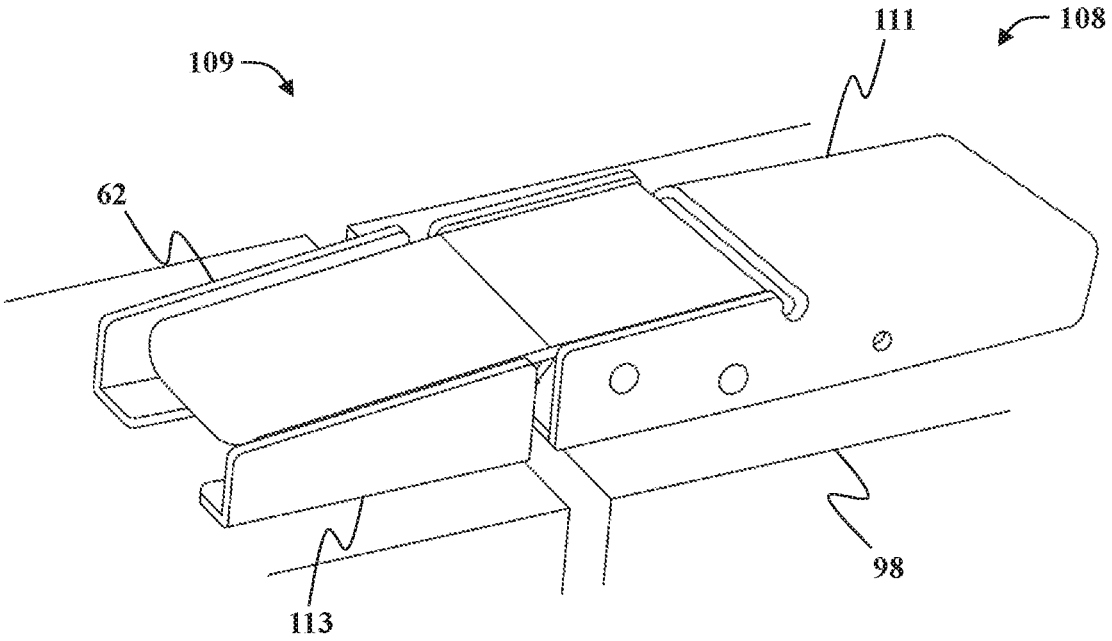
FIG. 8A is a perspective view of a latch mechanism that may be used with the end handle system shown in FIGS. 5A and 5B, with the latch mechanism in a locked position.
Figure 8B:
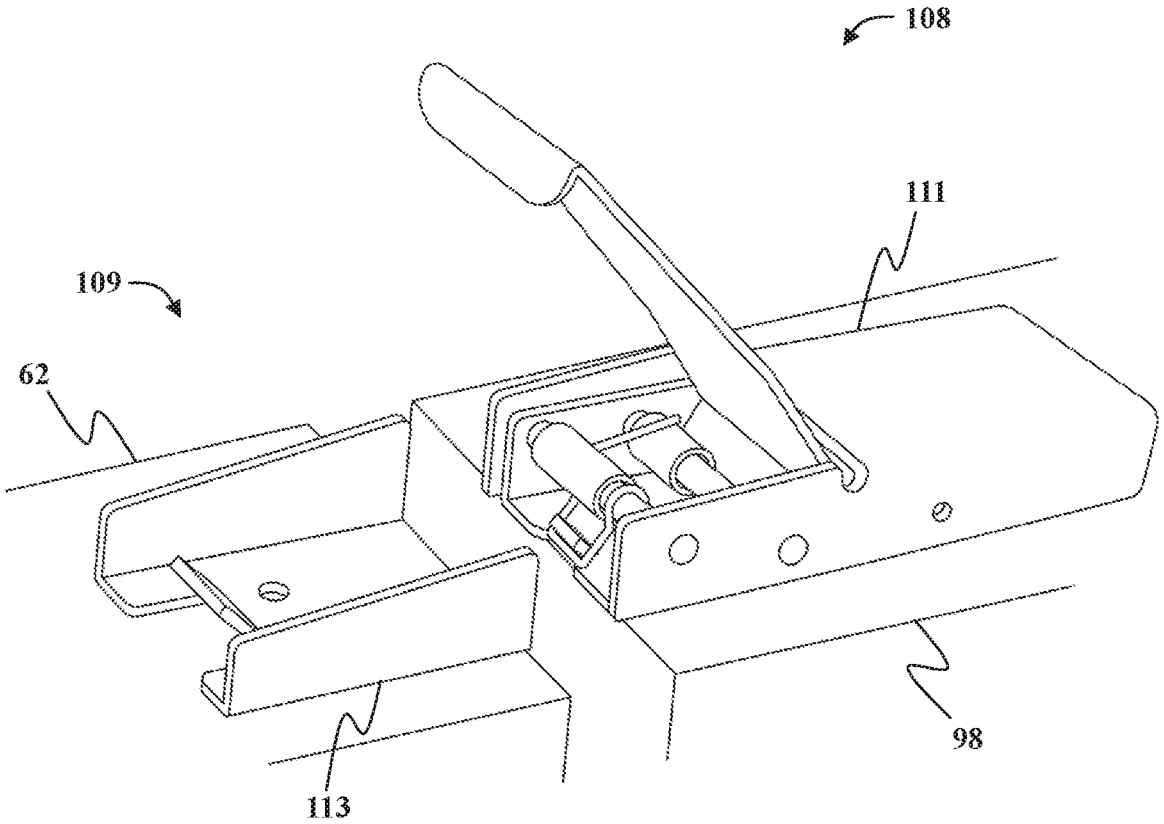
FIG. 8B is a perspective view of the latch mechanism in an unlocked position.
Figure 9:
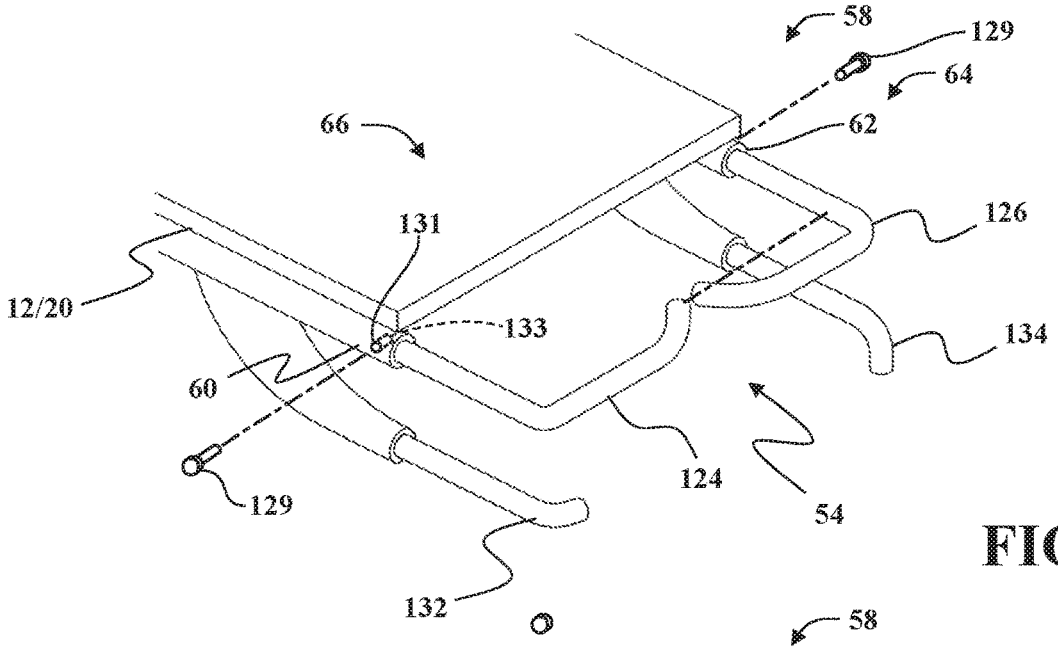
FIG. 9 is a partial perspective view of another end handle system.
Figure 10A:
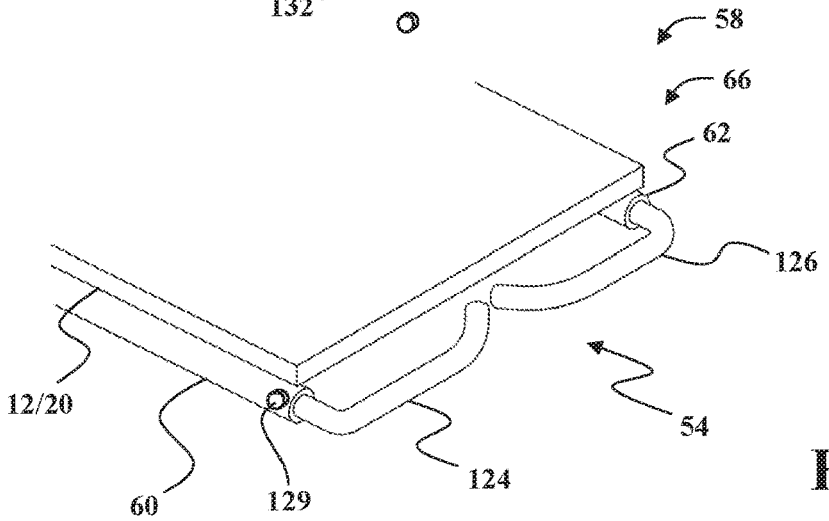
FIG. 10A is a perspective view of a portion of the end handle system shown in FIG. 9 in the closed configuration.
Figure 10B:
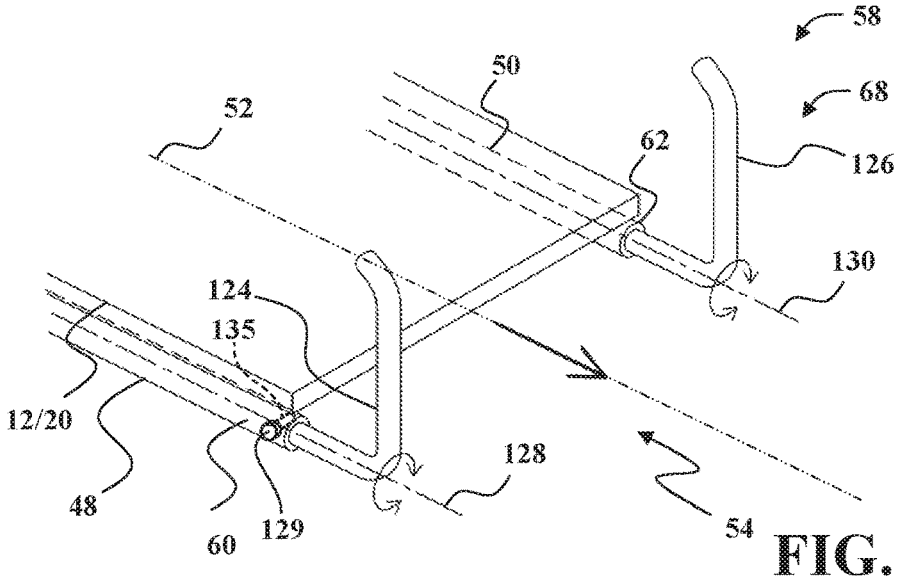
FIG. 10B is a perspective view of a portion of the end handle system shown in FIG. 9 in the open configuration.
Figure 11:
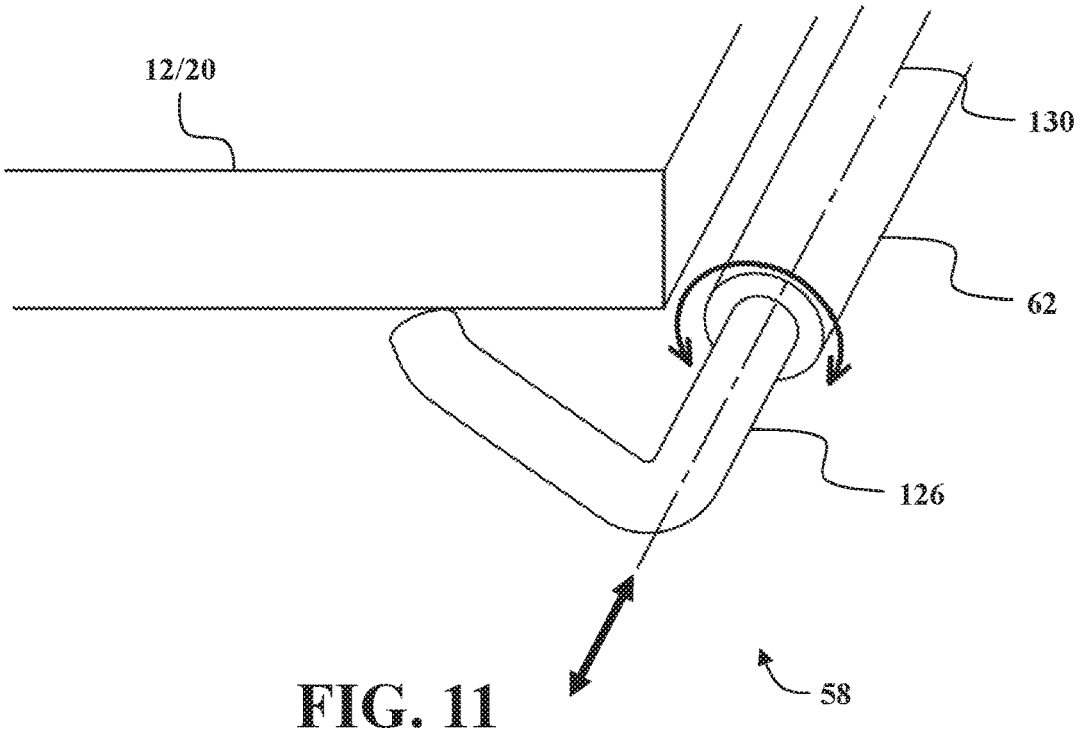
FIG. 11 is a perspective view of a handle that may be used with the end handle system shown in FIG. 9 in the closed configuration.
Figure 12:
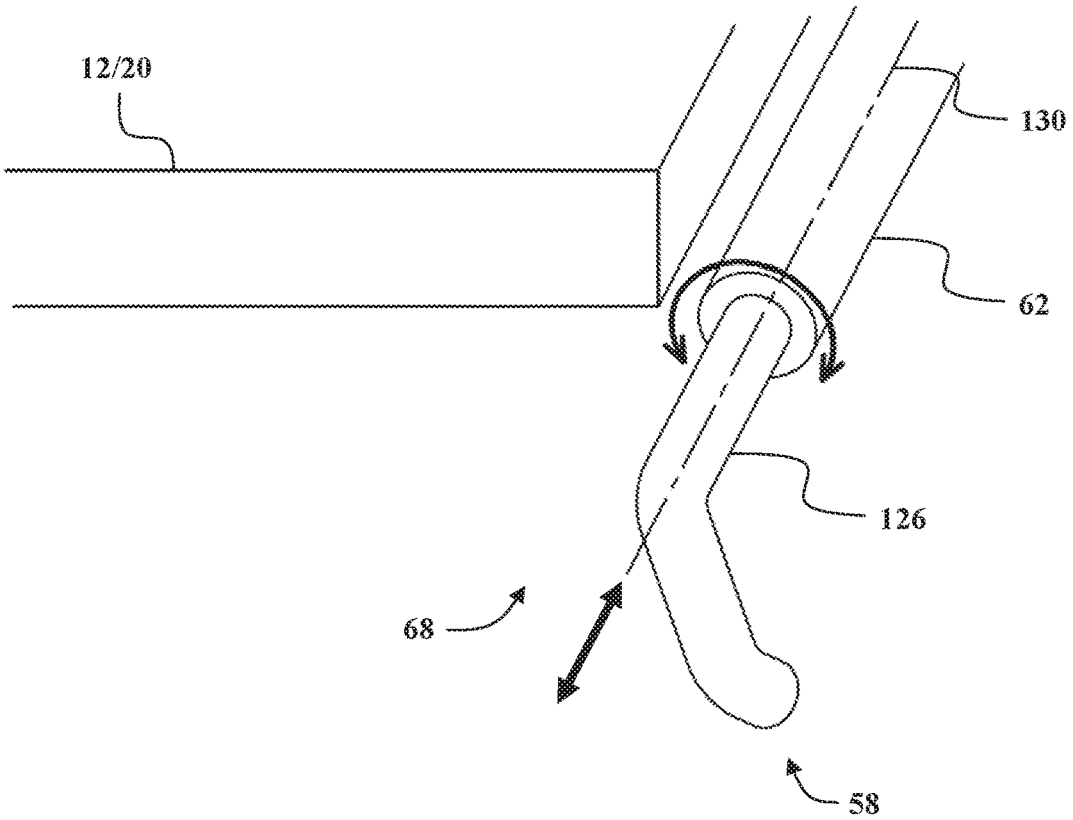
FIG. 12 is a perspective view of the handle that may be used with the end handle system shown in FIG. 9 in the open configuration.

The wagon handle assembly 98 also includes a latch mechanism 108 that is configured to releasably couple the wagon handle assembly 98 to the second support member 62 with the wagon handle assembly 98 in the closed configuration 66. The latch mechanism 108 may comprise any suitable latch/catch arrangement in which the latch on the wagon handle assembly 98 engages a catch on the second support member 62, or vice versa. In some embodiments, the latch mechanism 108 may include a toggle latch assembly 109 (shown in FIGS. 9A and 9B). The toggle latch assembly 109 includes a first latch member 111 that is releasably coupled to a second latch member 113 to position the toggle latch assembly 109 in a locked position (shown in FIG. 8A) to maintain the wagon handle assembly 98 in the closed configuration 66 and an unlocked position (shown in FIG. 8B) to enable the wagon handle assembly 98 to be moved to the open configuration 68. The first latch member 111 is coupled to the wagon handle assembly 98 and the second latch member 113 is coupled to the second support member 62.

In some embodiments, the wagon handle assembly 98 includes an upper support bar 110, a lower support bar 112, and a secondary handle assembly 114 that extends vertically between the upper support bar 110 and the lower support bar 112. The upper support bar 110 extends between the first support member 60 and the second support member 62 in the closed configuration 66. The upper support bar 110 is fixed at one end to the first pivot block 103*a* and is fixed at the other end to a latch block 115 that supports the first latch member 111. The upper support bar 110 extends between a first end 116 and an opposite second end 118 (see FIG. 6). The first end 116 of the upper support bar 110 is coupled to the pivot support 102. The lower support bar 112 is vertically spaced from the upper support bar 110.

The secondary handle assembly 114 includes a pair of handle support members 120 that extend between the upper support bar 112 and the lower support bar 112, and a cross member 122 that extends between the pair of handle support members 120 and is orientated perpendicular to the pair of handle support members 120. The secondary handle assembly 114 is rotatably coupled to the upper support bar 110 and is configured to rotate about the upper support bar 110 (see FIG. 7B). In some embodiments, as shown in FIG. 5B, the secondary handle assembly 114 may be releasably coupled to the lower support bar 112 (e.g., via hooks at the end of the handle support members 120) such that the secondary handle assembly 114 may rotate away from the lower support bar 112 as a caregiver rotates the secondary handle assembly 114 about the upper support bar 110. Accordingly, the secondary handle assembly 114 acts as a secondary handle for maneuvering the patient transport apparatus 10, such as a secondary wagon-type handle.

Figures 7A, 7B, 7C, 7D, 7E, 7F:
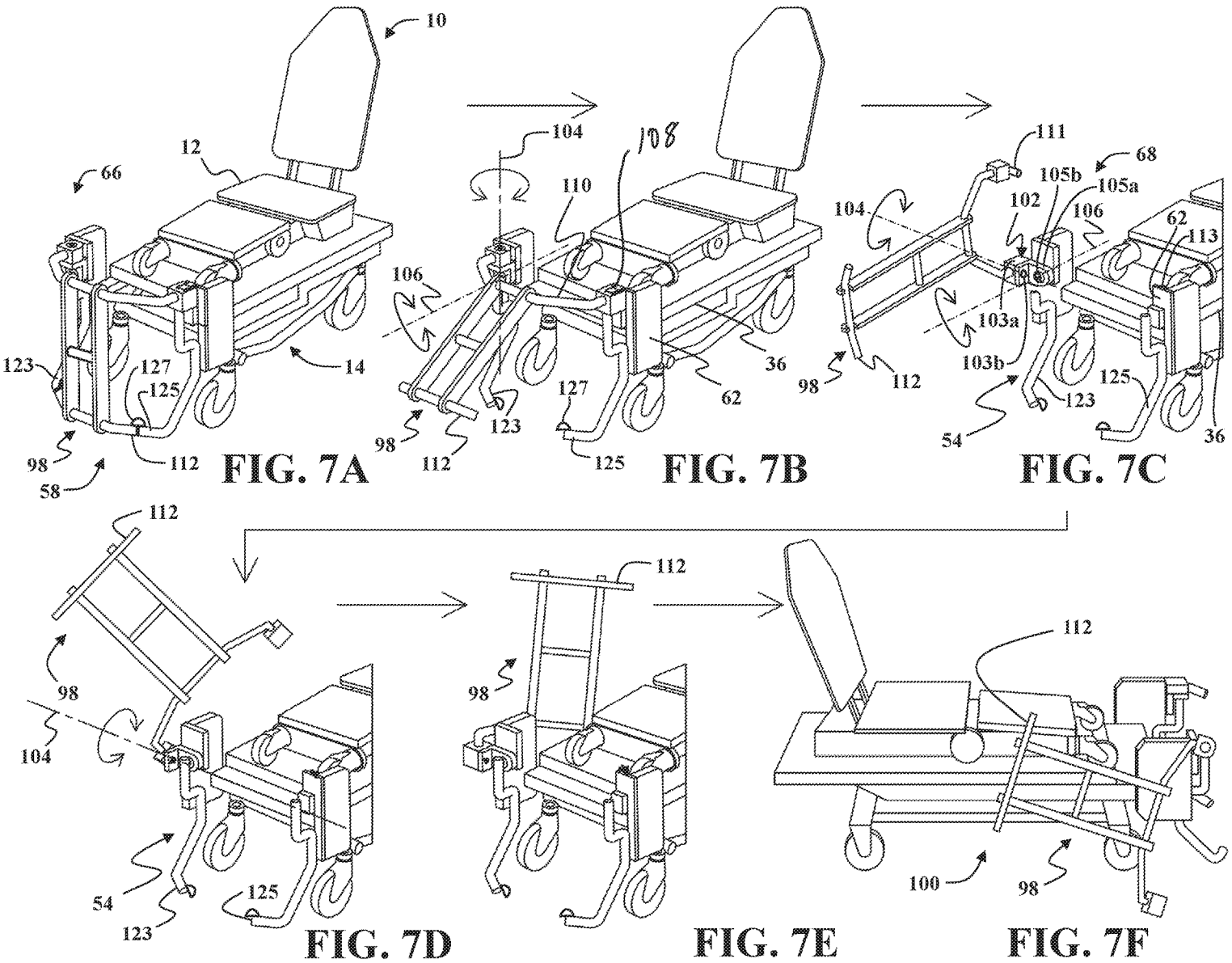
FIGS. 7A-7F are a sequence of images illustrating movement of the end handle system of FIGS. 5A and 6 from the closed configuration to a stowed configuration.

FIGS. 7A-7F illustrate movement of one version of the wagon handle assembly 98 from the closed configuration 66 (shown in FIG. 7A) to the open and stowed configurations 68, 100 (shown in FIGS. 7C and 7F). Notably, the version shown in FIGS. 7A-7F is the same as that shown in FIGS. 5A and 6, but slightly different from that shown in FIG. 5B. In the version of FIG. 5B, both the upper support bar 110 and the lower support bar 112 are connected in a fixed manner to the first pivot block 103*a* and the latch block 115 so that both can be moved to the open and stowed configurations upon operating the latch mechanism 108 to release the wagon handle assembly 98 from the second support member 62 and then by pivoting about axes 104, 106. In some versions, the wagon handle assembly 98 only pivots about axis 104 to move between the open and closed configurations. The version shown in FIGS. 5A, 6, and 7A-7F has the lower support bar 112 being releasably connected at its ends to opposing brackets 123, 125 (see FIG. 7B) via locking/securing mechanisms 127 to thereby require additional action to move to the open and stowed configurations. This also allows the secondary handle assembly 114 to rotate about the upper support bar 110. The locking/securing mechanisms 127 may be collars, clamps, hose clamps, fasteners, fittings, latches, catches, tape, hook and loop couplings, or any other suitable device for locking or securing the lower support bar 112 to the brackets 123, 125. In this version, the brackets 123, 125 are shown in the form of tubing that is fixed to the support members 60, 62 respectively, but may comprise any suitable form of brackets.

Referring to FIGS. 7A-7F, initially, the caregiver releases the lower support bar 112 from the brackets 123, 125 via the locking/securing mechanisms 127 and then grasps the lower support bar 112 and pivots the wagon handle assembly 98 outwardly from the litter support frame 36 and about the upper support bar 110, as shown in FIG. 7B (this action may also be performed to use the wagon handle assembly 98 for maneuvering the patient transport apparatus 10). The caregiver then operates the latch mechanism 108 to release the wagon handle assembly 98 from the second support member 62. The caregiver may then rotate the wagon handle assembly 98 away from the foot end 18 of the litter support frame 36 about the second pivot axis 106 using the pivot support 102, as shown in the sequence from FIGS. 7B to 7C (part of the bracket 123 has been broken away in FIG. 7C to better show the pivot blocks 103*a*, 105*a* and the pivot pins 103*b*, 105*b*). The user then is able to position the wagon handle assembly 98 into the stowed configuration 100 along the side of the litter support frame 36, as shown in FIGS. 7D-7F, by rotating the wagon handle assembly 98 about the first pivot axis 104. This process may be performed in reverse to move the wagon handle assembly 98 from the stowed configuration 100 to the closed configuration 66.

Referring to FIGS. 9-12, in some embodiments, the handle assembly 64 may include a pair of upper handles 124, 126 that are coupled to the support members 60, 62. For example, the handle assembly 64 includes a first upper handle 124 that is rotatably coupled to the first support member 60, and a second upper handle 126 that is rotatably coupled to the second support member 62. The first upper handle 124 extends outwardly from the first support member 60 parallel to the longitudinal axis 52 and is configured to rotate about a first rotational axis 128 (see FIG. 10B) that is orientated parallel to the longitudinal axis 52. The second upper handle 126 extends outwardly from the second support member 62 parallel to the longitudinal axis 52 and is configured to rotate about a second rotational axis 130 that is orientated parallel to the longitudinal axis 52. In the closed configuration 66, shown in FIG. 10A, the first upper handle 124 and the second upper handle 126 are orientated substantially horizontally and extend inwardly towards each other from the support members 60, 62. In the open configuration 68, shown in FIG. 10B, the first upper handle 124 and the second upper handle 126 are orientated substantially vertically such that the loading gap 54 is defined between the first and second upper handles 124, 126. The first upper handle 124 and the second upper handle 126 may be moved to any position suitable to open the loading gap 54. In some embodiments, the first and second upper handles 124, 126 may be configured as telescoping handles that are extendable/retractable with respect the longitudinal axis 52.

The first and second upper handles 124, 126 may be locked to the support members 60, 62 in the open and/or closed configurations in any suitable manner. For example, locking pins 129 may be employed in which throughholes 131 are located in the support members 60, 62 (which are hollow in the version shown) to receive the locking pins 129 (see FIG. 9) and the first and second upper handles 124, 126 have corresponding throughholes 133, 135 (See FIGS. 9 and 10B) that align with the throughholes 131 in the open and closed configurations, respectively, to receive the locking pins 131 to lock the first and second upper handles 124, 126 in the open and closed configurations.

In some embodiments, the handle assembly 64 may also include a first lower handle 132 and a second lower handle 134 that are each positioned vertically below the upper handles 124, 126. In some versions, such as that shown, the first lower handle 132 and the second lower handle 134 are static handles fixed to the litter support frame 36 for lifting or otherwise maneuvering the patient transport apparatus 10. In some versions, the first lower handle 132 is the same shape and configuration as the first upper handle 124 and is rotatably coupled to the first support member 60 and the second lower handle 134 is the same shape and configuration as the second upper handle 126 and is rotatably coupled to the second support member 62 such that the first and second lower handles 132, 134 are movable between the closed configuration 66 and the open configuration 68.

It will be further appreciated that the terms "include," "includes," and "including" have the same meaning as the terms "comprise," "comprises," and "comprising." Moreover, it will be appreciated that terms such as "first," "second," "third," and the like are used herein to differentiate certain structural features and components for the non-limiting, illustrative purposes of clarity and consistency.

Several configurations have been discussed in the foregoing description. However, the configurations discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

The invention claimed is:

1. A patient transport apparatus comprising:

a patient litter to support a patient; and a litter support apparatus for supporting said patient litter above a ground surface, said litter support apparatus comprising a litter support frame including:

a pair of litter supports including a first litter support spaced a distance from a second litter support to define a loading gap for receiving said patient litter therethrough; and a handle system coupled to said pair of litter supports, said handle system including:

a locking member coupled to one of said pair of litter supports, and a handle assembly coupled to the other of said pair of litter supports and being positionable between a closed configuration and an open configuration, said handle assembly positioned away from the loading gap in the open configuration, and extending across the loading gap defined between said pair of litter supports into releasable engagement with said locking member in the closed configuration.

2. The patient transport apparatus of claim 1, wherein said handle system includes a first support member coupled to said first litter support and a second support member coupled to said second litter support, said handle assembly including:

an upper crossbar extending between said first and second support members, a lower crossbar spaced a vertical distance from said upper crossbar; and wherein said upper crossbar and said lower crossbar are movable between the closed configuration and the open configuration.

3. The patient transport apparatus of claim 2, wherein said upper crossbar is pivotably coupled to said first support member and rotatable about a first pivot axis.

4. The patient transport apparatus of claim 3, wherein said locking member is further defined as a first locking member and wherein said second support member includes said first locking member, said first locking member being configured to engage said upper crossbar with said upper crossbar in the closed configuration.

5. The patient transport apparatus of claim 4, wherein said lower crossbar is pivotably coupled to said second support member and rotatable about a second pivot axis.

6. The patient transport apparatus of claim 5, wherein said first support member includes a second locking member configured to engage said lower crossbar with said lower crossbar in the closed configuration.

7. The patient transport apparatus of claim 2, wherein said upper crossbar and said lower crossbar are orientated vertically in the open configuration.

8. The patient transport apparatus of claim 1, wherein said handle assembly includes a first collapsible cage assembly coupled to said first litter support and a second collapsible cage assembly coupled to said second litter support.

9. The patient transport apparatus of claim 8, wherein said first collapsible cage assembly contacts said second collapsible cage assembly in the closed configuration; and wherein said first collapsible cage assembly is spaced apart from said second collapsible cage assembly in the open configuration such that the loading gap is defined therebetween.

10. The patient transport apparatus of claim 8, wherein said first collapsible cage assembly and said second collapsible cage assembly each include a plurality of links pivotably coupled together and configured to form a substantially rectangular shape in the closed configuration and a substantially planar shape in the open configuration.

11. The patient transport apparatus of claim 10, wherein said first collapsible cage assembly is pivotably coupled to said first litter support and rotatable about a first vertical pivot axis; and wherein said second collapsible cage assembly is pivotably coupled to said second litter support and rotatable about a second vertical pivot axis.

12. The patient transport apparatus of claim 1, wherein said handle assembly includes a wagon handle assembly pivotably coupled to said first litter support and extending between said first litter support and said second litter support in the closed configuration.

13. The patient transport apparatus of claim 12, wherein said handle system includes a first support member coupled to said first litter support and a second support member coupled to said second litter support, and said wagon handle assembly includes a pivot support coupled to said first support member, said pivot support configured to allow rotation of said wagon handle assembly about a first pivot axis and a second pivot axis.

14. The patient transport apparatus of claim 13, wherein said wagon handle assembly is positionable to a stowed configuration along a side of said litter support apparatus.

15. The patient transport apparatus of claim 13, wherein said wagon handle assembly includes an upper support bar extending between said first and second support members;

a lower support bar spaced a vertical distance from said upper support bar; and a secondary handle assembly extending between said upper support bar and said lower support bar.

16. The patient transport apparatus of claim 15, wherein said secondary handle assembly is rotatably coupled to said upper support bar and configured to rotate about said upper support bar.

17. The patient transport apparatus of claim 15, wherein said upper support bar extends between a first end and a second end, the first end being coupled to said pivot support.

18. The patient transport apparatus of claim 17, wherein said wagon handle assembly includes a latch mechanism configured to releasably couple said wagon handle assembly to said second support member with said wagon handle assembly in the closed configuration.

19. The patient transport apparatus of claim 1, wherein said handle assembly includes:

a first upper handle rotatably coupled to said first litter support and configured to rotate about a first rotational axis; and a second upper handle rotatably coupled to said second litter support and configured to rotate about a second rotational axis parallel to the first rotational axis.

20. The patient transport apparatus of claim 19, wherein said first and second upper handles are configured to be orientated substantially horizontally in the closed configuration; and wherein said handle assembly includes a first lower handle and a second lower handle.

* * * * *